US006378596B1

(12) United States Patent
Arrigotti et al.

(10) Patent No.: US 6,378,596 B1
(45) Date of Patent: Apr. 30, 2002

(54) DEVICE FOR REGULATING THE EVACUATION OF AIR AND GAS FROM CASTING DIES

(75) Inventors: Fausto Arrigotti, Capriano Del Colle; Sergio Arrigotti, Brescia, both of (IT)

(73) Assignee: Unitecno S.r.l. (IT)

( * ) Notice: Subject to any disclaimer, the term of this patent is extended or adjusted under 35 U.S.C. 154(b) by 0 days.

(21) Appl. No.: 09/614,742

(22) Filed: Jul. 12, 2000

(30) Foreign Application Priority Data

Aug. 5, 1999 (IT) ..... BS99A0078

(51) Int. Cl.[7] ..... B22D 17/00; B22D 17/04; B28B 17/00

(52) U.S. Cl. ..... 164/305; 164/312; 425/420; 425/812; 251/127

(58) Field of Search ..... 164/305, 312; 425/420, 812; 251/126, 127, 251, 264

(56) References Cited

U.S. PATENT DOCUMENTS 590,988 A * 10/1897 Hughes
4,154,285 A * 5/1979 Yamasaki et al. ..... 164/133
4,938,274 A * 7/1990 Iwamoto et al. ..... 164/4.1
4,995,445 A * 2/1991 Shigyo ..... 164/305
5,586,596 A * 12/1996 Freeman ..... 164/253
5,913,356 A * 6/1999 Muramatsu ..... 164/305

* cited by examiner

*Primary Examiner*—M. Alexandra Elve
*Assistant Examiner*—Len Tran
(74) *Attorney, Agent, or Firm*—McGlew and Tuttle, P.C.

(57) ABSTRACT

A device for regulating the evacuation of air and gas from a casting die. It comprises two complementary bodies (11, 12), which can be closed, face to face, one on top of another, and which delimit an evacuation channel (13). The evacuation channel (13) is defined by a static surface (16) of the first of the bodies (12) and by a movable surface (18) that is arranged in front of and in parallel to the static surface (16) and that consists of the front surface of a movable element (17). The movable element (17) is arranged in the second of the bodies (11) and can be moved at right angles to the static surface (16) in order to vertically adjust the section of the evacuation channel.

9 Claims, 2 Drawing Sheets

DEVICE FOR REGULATING THE EVACUATION OF AIR AND GAS FROM CASTING DIES

FIELD OF THE INVENTION

The present invention pertains to devices for an evacuation of air and gas from the dies used in the casting of pieces.

BACKGROUND OF THE INVENTION

In the die-casting process, one of the most difficult problems to be solved is the correct and complete evacuation of air and gas from the die for forming the piece. The presence of air and gas is also due, among other things, to the effect of evaporation from cooling and/or of splashes on the surface during the phase of filling of the die. If they are not eliminated, the air and gas can remain included in the casting, compromising the structure and quality of the finished piece.

Various systems for the evacuation of air and gas from casting dies which are connected to a suction apparatus or vacuum apparatus already exist on the market. These prior-art systems do not, however, have adjustability features; therefore, they also do not have the versatility to be adapted to the different conditions of operation that may be found in the casting process.

In fact, in die-casting, the variables may be varied, linked with the velocity of the injection piston, with the state of wear and tear, with the passages of the gate section, with the thicknesses of the mold, which are not always uniform, with the temperatures of the lubricants, with the insistence times, and with the many other modifiable features, all of which together contribute to changing and requiring a specific response of evacuation of gaseous fluids over time and because of the amount.

SUMMARY AND OBJECTS OF THE INVENTION

The object of the present invention is to provide a device, which is improved and which can be readily and easily adjusted, even during use, to effectively regulate the evacuation of air and gas from the casting dies and therefore to efficiently solve the problems stated above of the prior art.

Another object of the present invention is to produce a device for regulating the discharge of air and gas from the casting dies, which has high flexibility and adaptability, with a channel, whose section can be finely adjusted for a correct action of evacuation of air and gas and with the purpose of obtaining the most excellent productivity and quality results possible, which can, moreover, be verified by means of a test analysis of the finished pieces.

In accordance with the present invention a device is provided which comprises two complementary bodies which can be closed face to face one on top of another, which has, between said bodies, an evacuation channel, which is connected, on the one hand, to a casting die, and on the other hand, possibly to a vacuum gearcase, and where said channel has a section that can be adjusted, at least in the direction of its height, by means of a movement of an element that is movable in relation to a static surface with which it contributes to delimiting the said channel. This movable element is arranged between the two bodies of the device facing one another, and the fixed surface of the channel is that of one of these bodies. The movable element can be moved at right angles to the fixed surface by a wedge-shaped member, which is moved by a drive shaft.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
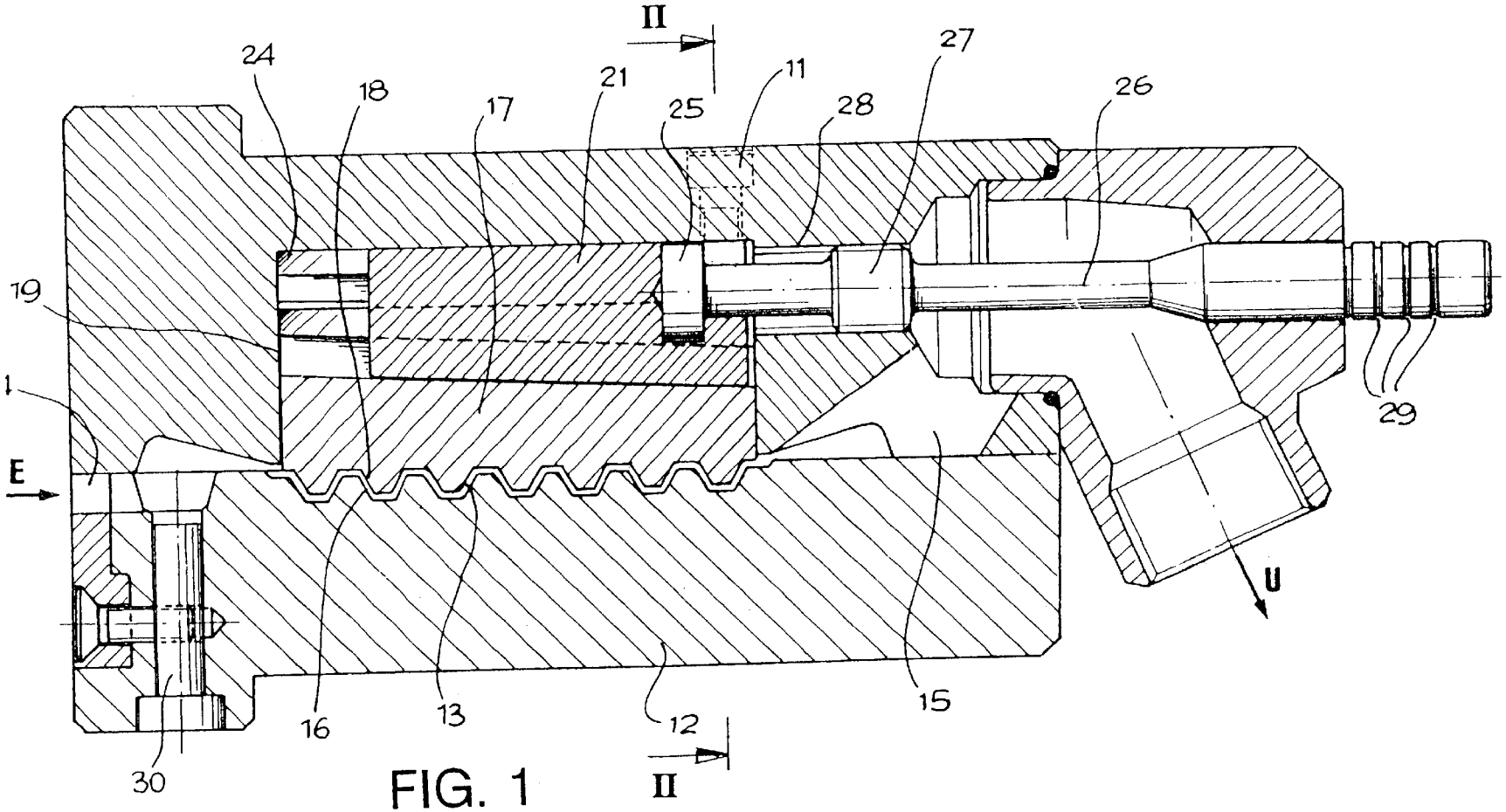
FIG. 1 is a longitudinal sectional view taken along line I—I of FIG. 2, showing the device in its entirety.
Figure 2:
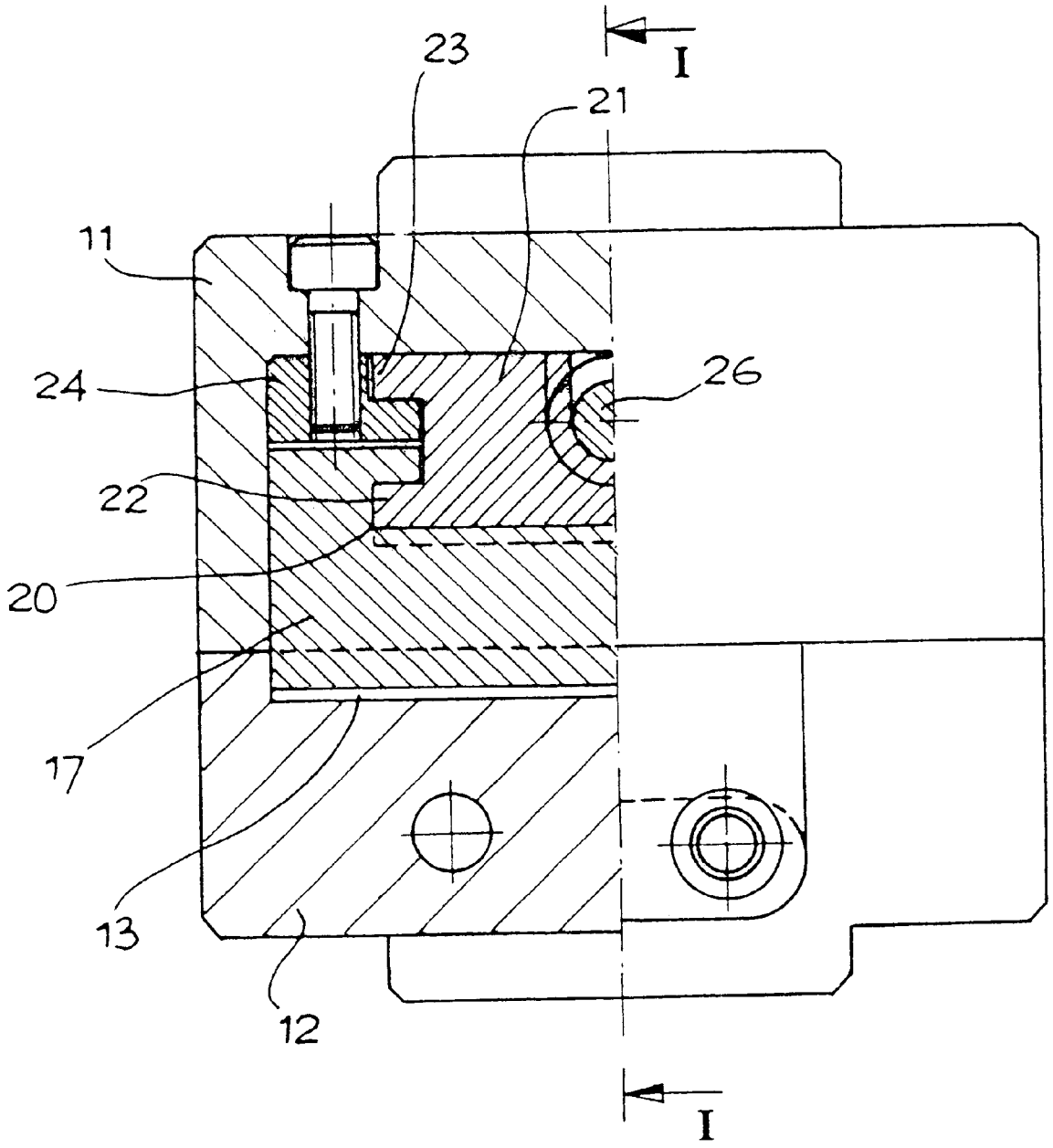
FIG. 2 is a partial cross sectional view taken along line II—II of FIG. 1, showing the device of FIG. 1.

Referring to the drawings in particular, the device according to the invention comprises two complementary bodies 11, 12, which can be closed one on top of another and which delimit between them an evacuation channel 13. One body 11, which is the top one in the drawings, is fixed and is joined to a fixed plane of a casting die (not shown). The other body 12 is movable and can be moved towards and away from the fixed body, and is joined to a movable plane of the said die.

The evacuation channel 13 has a wavy, comb-like, or similar flow and extends from an inlet 14 which is connected according to the arrow E, to the mold for molding a piece in the die, to an outlet 15 which is connected, according to the arrow U, optionally to a vacuum gearcase (FIG. 1).

The channel 13, between the inlet 14 and the outlet 15, is delimited by a static surface 16. In the example shown, the static surface 16 corresponds to the internal surface of the movable body 12, and by a movable element 17 having in its turn a front surface 18 in front of and with a flow parallel to the static surface 16.

More specifically, the movable element 17 is arranged in a cavity 19, if need be, provided in the fixed body and it can be moved perpendicular to the static surface 16 for vertically varying the section of the evacuation channel 13.

For this movement, the movable element 17 has, on its face opposite the front surface 18, a longitudinal guide 20, e.g., dovetail or T-shaped, extending into a plane that is sloped with respect to the plane in which the evacuation channel lies. By means of guide 20, the movable element 17 is joined to a longitudinally movable, wedge-shaped positioning member 21. This wedge-shaped member 21 has a sloped counterguide 22, which interacts with the guide 20 of the movable element 17 and a second guide 23 guided on slide gibs that are connected to the fixed body 11 in the cavity 19 and extend in parallel to the plane in which the evacuation channel lies.

In this way, thanks to the sloped guides 20, 22, vertical movements of the movable element 17 with respect to the static surface 16 of the channel 13 and correspondingly the height variation of the section of the evacuation channel 13 correspond to the longitudinal horizontal movements of the wedge-shaped member 21 in one direction or the other along the slide gibs 24.

For its longitudinal movements, a drive shaft 26 guided in the fixed body 11 and extending outside of same on one side, e.g., on the side of the outlet of the channel 13, which may or may not be connected to the vacuum device or vacuum gearcase/assembly, is connected to the wedge-shaped member 21 by means of a rotating coupling 25. The shaft 26 has an intermediate threaded portion 27, which is joined to a corresponding threaded hole 28 made in the fixed body 11. The shaft 26 may be rotated by any manual or non-manual pressing means, and thanks to this threaded coupling 27, 28, its axial translation and a corresponding longitudinal horizontal movement of the wedge-shaped member for the vertical adjustment, as needed and as stated above, of the section of the evacuation channel, corresponds to its rotation.

Finally, reference signs 29 that are visible and are indicative of the position of the movable element 17 inside the device and correspondingly of the height of the evacuation channel 13 may be provided along the drive shaft 26. The air and gas coming from the die are evacuated by means of this channel, which may be adjusted depending on the conditions of the casting process, as well as during this process, especially while making adjustments to achieve the maximum balance between quality and the rest of the variables. However, molten metal may enter the channel, which, once it has solidified, forms an element that can then be extracted by opening the two bodies and with the possible aid of an extractor 30.

While a specific embodiment of the invention has been shown and described in detail to illustrate the application of the principles of the invention, it will be understood that the invention may be embodied otherwise without departing from such principles.

What is claimed is:

1. A device for regulating the evacuation of air and gas from a casting die, the device comprising:

a first body having an internal static surface;

a second body with a moveable element having a front moveable surface, said first and second bodies being two complementary bodies positioned face to face one on top of another to form a wavy shaped substantially horizontally extending evacuation channel arranged between said first body and said second body with an inlet end and an outlet end, said two complementary bodies being connectable at said inlet end to a die and said two complementary bodies being connectable at said outlet end to a vacuum device, said evacuation channel being delimited by said internal static surface of said first body and by a front vertically movable surface of said movable element, said front vertically movable surface being arranged in front of and in parallel to said static surface and being movable perpendicular to said static surface to vertically adjust the section of said evacuation channel; and a wedge-shaped positioning member and guides, wherein said movable element is arranged in a cavity of said second body and is joined to said wedge-shaped positioning member, which is guided in said second body and can be longitudinally moved in a plane that is parallel to a plane in which said evacuation channel lies, said movable element and said positioning member being coupled via said guides which are sloped with respect to the plane in which said evacuation channel lies such that a vertical movement of said movable element above the static surface of the channel corresponds to each longitudinal movement of said positioning member.

2. A device in accordance with claim 1, further comprising a drive shaft, wherein said wedge-shaped positioning member, for its longitudinal movements, is connected to said drive shaft, rotating and translating in said second body, said drive shaft being manually or mechanically actuated and having a threaded portion, which is joined to a corresponding threaded hole provided in said second body.

3. A device in accordance with claim 2, wherein said drive shaft has references, said references being visible and being indicative of the position of said movable element with respect to said static surface and of the height of the section of said evacuation channel.

4. A device for regulating the evacuation of air and gas from a casting die, the device comprising:

a first body having an internal static surface;

a second body, said first and second bodies being two complementary bodies positioned face to face one on top of another, said second body defining a moveable element space;

a moveable element in said movable element space, said movable element having a front moveable surface, an evacuation channel being provided between said first body and said second body with an inlet end and an outlet end, said two complementary bodies being connectable at said inlet end to a die and said two complementary bodies being connectable at said outlet end to a vacuum device, said evacuation channel being at least partly delimited by said internal static surface of said first body and by a front vertically movable surface of said movable element, said front vertically movable surface being arranged in front of and in parallel to said static surface;

movable body drive means for moving said vertically movable surface perpendicular to said static surface to variably adjust the vertical section of said evacuation channel, said movable body drive means comprising a wedge-shaped positioning member and guides, wherein said movable element is arranged in a cavity of said second body and is joined to said wedge-shaped positioning member, said positioning being guided in said second body and being longitudinally moved in a plane that is parallel to a plane in which said evacuation channel lies, said movable element and said positioning member being coupled via said guides which are sloped with respect to the plane in which said evacuation channel lies such that a vertical movement of said movable element above the static surface of channel corresponds to each longitudinal movement of said positioning member.

5. A device in accordance with claim 4, wherein said movable body drive means further comprises a drive shaft, wherein said wedge-shaped positioning member, for its longitudinal movements, is connected to said drive shaft, rotating and translating in said second body, said drive shaft being manually or mechanically actuated and having a threaded portion, which is joined to a corresponding threaded hole provided in said second body.

6. A device in accordance with claim 5, wherein said drive shaft has references, said references being visible and being indicative of the position of said movable element shaft respect to said static surface and of the height of the section of said evacuation channel.

7. A device for regulating the evacuation of air and gas from a casting die, the device comprising:

a first body having an internal static surface;

a second body, said first and second bodies being two complementary bodies positioned face to face one on top of another, said second body defining a moveable element space;

a moveable element in said movable element space, said movable element having a front moveable surface, an evacuation channel being provided between said first body and said second body with an inlet end and an outlet end, said two complementary bodies being connectable at said inlet end to a die and said two complementary bodies being connectable at said outlet end to a vacuum device, said evacuation channel being at least partly delimited by said internal static surface of said first body and by a front vertically movable surface of said movable element, said front vertically movable surface being arranged in front of and in parallel to said static surface;

a drive member; and a transmission transmitting motion of said drive member to said moveable element for moving said vertically movable surface perpendicular to said static surface to variably adjust the section of said evacuation channel, said transmission including a wedge-shaped positioning member and guides, wherein said movable element is arranged in a cavity of said second body and is joined to said wedge-shaped positioning member, said positioning member being guided in said second body and being longitudinally moved in a plane that is parallel to a plane in which said evacuation channel lies, said movable element and said positioning member being coupled via said guides which are sloped with respect to the plane in which said evacuation channel lies such that a vertical movement of said movable element above the static surface of the channel corresponds to each longitudinal movement of said positioning member.

8. A device in accordance with claim 7, wherein said drive member comprises a drive shaft, wherein said wedge-shaped positioning member, for its longitudinal movements, is connected to said drive shaft, rotating and translating in said second body, said drive shaft being manually or mechanically actuated and having a threaded portion, which is joined to a corresponding threaded hole provided in said second body.

9. A device in accordance with claim 8, wherein said drive shaft has references, said references being visible and being indicative of the position of said movable element with respect to said static surface and of the height of the section of said evacuation channel.

* * * * *